United States Patent [19]

Costales et al.

[11] 4,383,402

[45] May 17, 1983

[54] TANGENTIALLY DRIVEN RING

[76] Inventors: Manuel Costales; Moustafa I. Hakki, both of P.O. Box 884, Belmont, N.C. 28012

[21] Appl. No.: 43,738

[22] Filed: May 30, 1979

[51] Int. Cl.[3] ..... D01H 7/58

[52] U.S. Cl. ..... 57/105; 57/122; 57/124

[58] Field of Search ..... 57/75, 105, 122, 124

[56] References Cited

U.S. PATENT DOCUMENTS

| | | | |
|---|---|---|---|
| 2,541,238 | 2/1951 | Goree | 57/124 |
| 2,563,187 | 8/1951 | Pennati | 57/124 |
| 3,025,657 | 3/1962 | Noordenbos | 57/124 X |
| 3,738,094 | 6/1973 | Costales et al. | 57/124 X |
| 4,023,340 | 5/1977 | Costales et al. | 57/124 X |
| 4,090,348 | 5/1978 | DeVittorio | 57/124 X |
| 4,112,666 | 9/1978 | Costales et al. | 57/124 X |
| 4,114,359 | 9/1978 | Creus | 57/124 |

FOREIGN PATENT DOCUMENTS

| | | | |
|---|---|---|---|
| 448589 | 4/1977 | Spain | 57/124 |

*Primary Examiner*—John Petrakes
*Attorney, Agent, or Firm*—Wendell Coffee

[57] ABSTRACT

The revolving rings on a spinning machine, as seen in U.S. Pat. No. 4,112,666, are rotated by a belt encircling six of the rings. Idler pulleys push the belt tangentially against the rings so that they are driven by the belt being tangentially pressed against them.

3 Claims, 3 Drawing Figures

TANGENTIALLY DRIVEN RING

BACKGROUND OF THE INVENTION (1) Field of the Invention

This invention relates to textile machines for spinning, twisting and twining and more particularly for machines with rotating rings.

(2) Description of the Prior Art

Previous workers in the art have suggested that the rings of a spinning machine be rotated. We have patented machines with rotating rings, both in U.S. Pat. Nos. 3,738,094 and 4,023,340.

In our U.S. Pat. No. 4,112,666, we patented a machine having a compensating drive. The drive belt is trained from the drive pulley on the spindle rail around an idler pulley and around a shell which drives four or more rings directly. The idler pulleys are moved out and in to compensate for the difference between the drive pulley and the shell.

SUMMARY OF THE INVENTION (1) New and Different Functions

According to this invention, the drive belt is trained from the drive pulley on the spindle rail around idler pulleys which move in and out as in the previous compensating drive discussed above. However, at the ring rail, the belt is directed by idlers to extend along a line of a group of six or more rings and around them back to the directional idlers at the end of the arm. The rings are driven tangentially by having the belt pressed in against the rings by ring idlers.

(2) Objects of this Invention

An object of this invention is to spin, twist or twine fibrous yarn or continuous filament.

Another object of this invention is to provide an improved drive means for rotating spinning rings.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
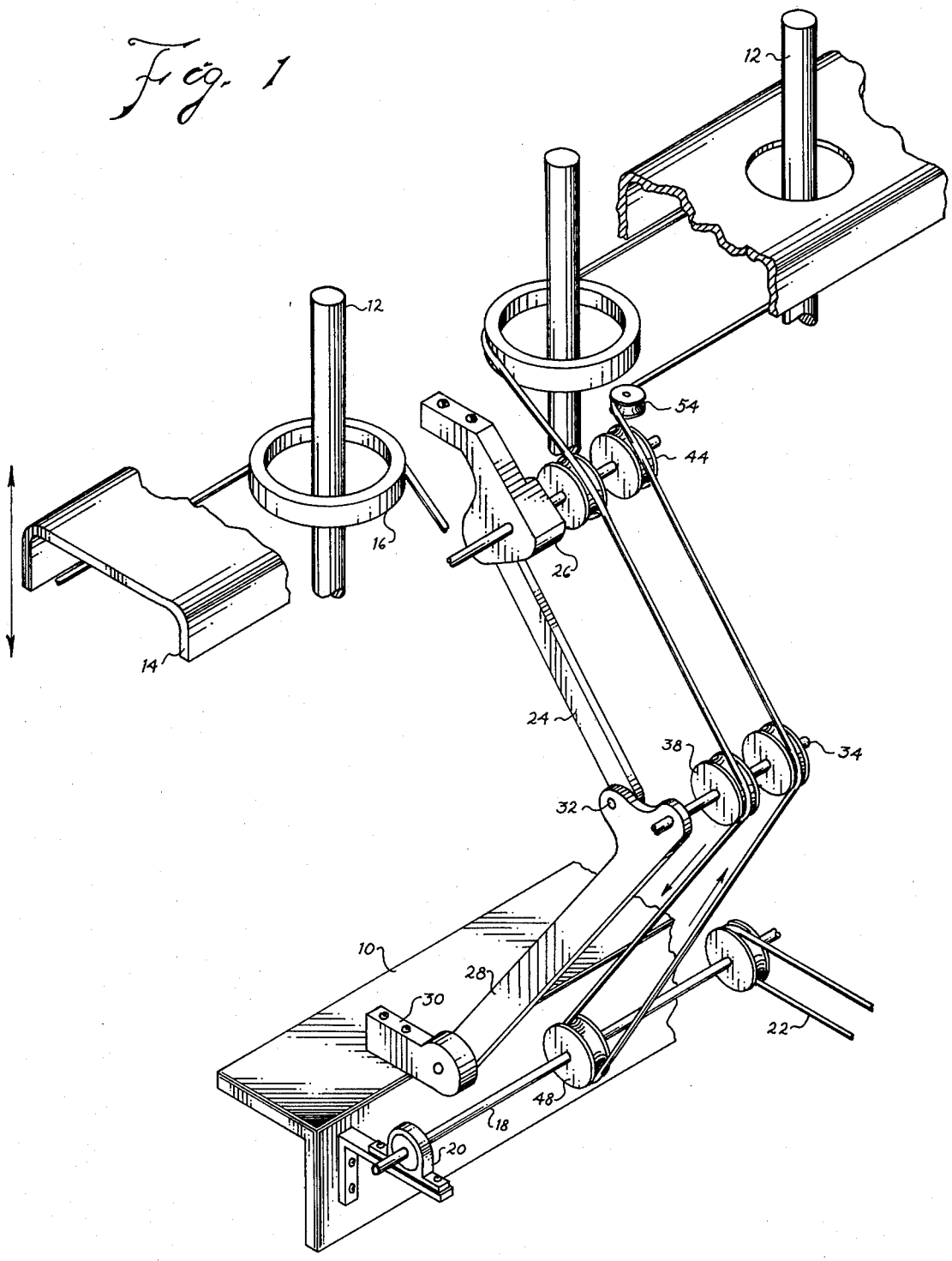
FIG. 1 is a perspective view of a portion of a spinning machine with an embodiment of our invention attached thereto.

Referring to the drawing, there may be seen illustrated a conventional spinning machine in many respects. Specifically, the machine has a frame which includes spindle rail 10. Vertical bobbin spindles 12 are journalled to spindle rail (not shown but conventional). Each vertical spindle 12 is the spindle on which the bobbin is placed to wind the yarn upon. The spindle has a conventional rotating means. We find it desirable not to show many conventional parts of the machine for simplicity and clarity of the drawing. These parts have been well known to the art for many years and are shown in our previous patents identified above.

Ring rail 14 is mounted upon the machine for up and down movement or vertical reciprocation relative to the spindle rail 10.

Those skilled in the art will understand that a machine will have a plurality of spindles 12 thereon and that the ring rail 14 would surround each of the spindles.

Rings 16 are journalled for rotation upon the rail 14. Traveler 17 is slidably mounted upon each ring. It will be understood that the ring in this particular case would have a ring holder and that the entire assembly is called the ring herein for conciseness. Also the rings 16 have vertical axes. Particularly, our U.S. Pat. No. 4,122,666 shows the details of such a ring and holder and the way it is journalled to the rail.

Horizontal drive shaft 18 extends the length of the machine. As shown, the drive shaft is journalled by bearings 20 to the spindle rail 10. The drive shaft 18 itself is driven by drive element 22 in the form of a belt.

Ring arm 24 is pivoted to the ring rail 14 by ring bracket 26. Spindle arm 28 is pivoted to the spindle rail 10 by spindle bracket 30. The ring arm 24 and the spindle arm 28 are pivoted together at the knee 32. Horizontal knee shaft 34 extends through the end of one of the arms, specifically, the spindle arm 28 near the knee 32. Two horizontal knee idlers 36 are journalled to the shaft 34 on one side and two additional horizontal knee idlers 38 are journalled to the shaft 34 on the other side of the knee.

Two horizontal arm idlers 42 are journalled on one side of horizontal arm shaft 40 and two additional horizontal arm idlers 44 are journalled to the arm shaft 40 on the other side of the ring bracket 26. The horizontal arm shaft is attached in the ring bracket 26 and is parallel to the horizontal drive shaft 18 and to the horizontal knee shaft 34. Horizontal drive pulley 46 is mounted upon drive shaft 18 in line with knee idlers 36 and drive pulley 48 is attached to drive shaft 18 in line with knee idlers 38. Vertical directional idler 50 is mounted upon cross bar 52 in line with the arm idler 42. Vertical directional idler 54 is mounted upon the other end of the cross bar in line with arm idler 44.

The cross bar 52 (not shown in FIG. 1 for clarity) is attached to bracket 26.

Figures 2, 3:
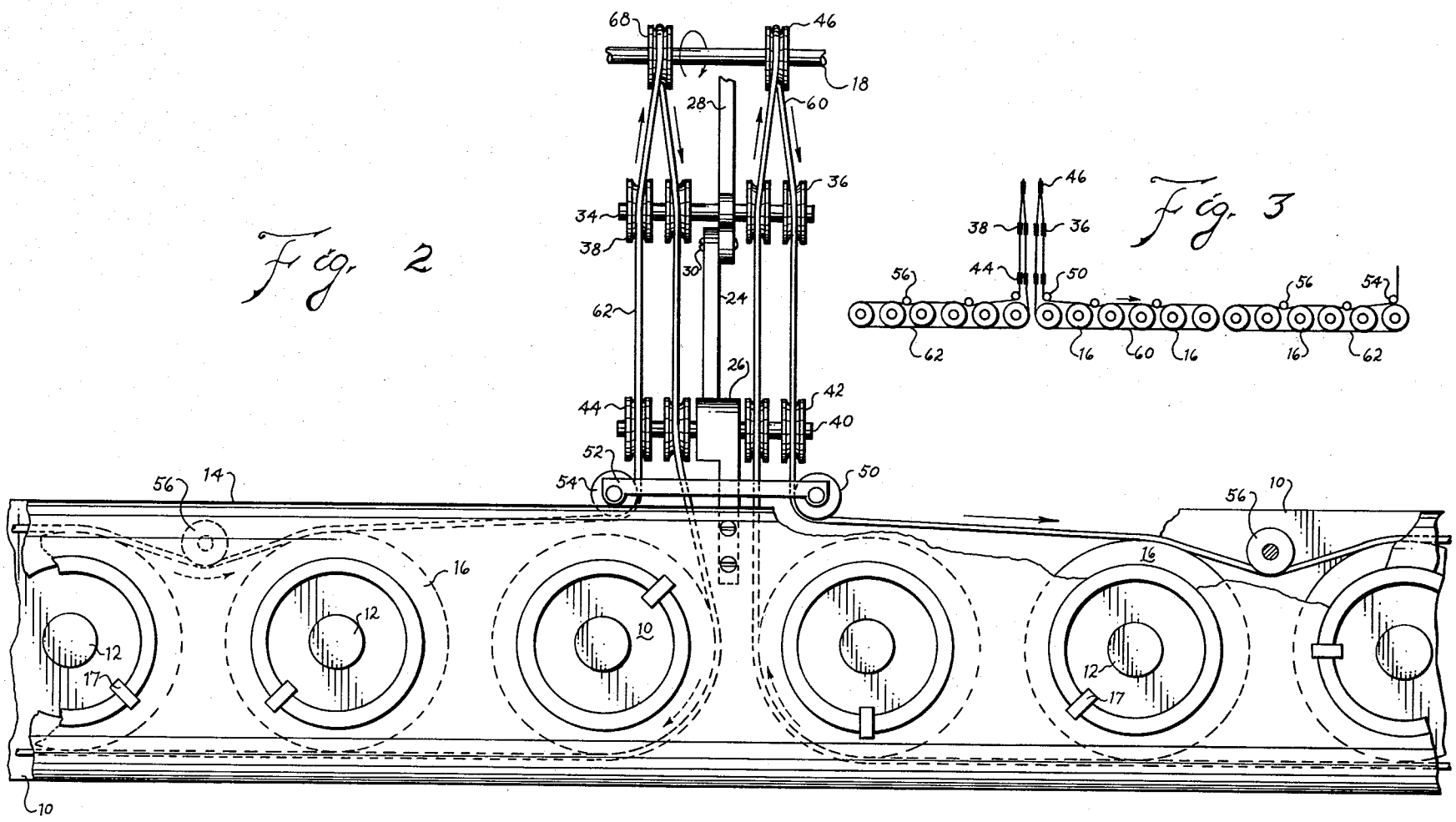
FIG. 2 is a plan view with parts broken away for clarity showing a portion of the machine.
FIG. 3 is a plan schematic representation showing the relationship of some of the rotating rings.

At least four vertical ring idlers 56 are attached to the ring rail 14 between rings with vertical axis 16. Belt 60 is trained around the pulleys and is particularly trained around drive pulley 46. The drive shaft 18 rotates in the direction of the arrows shown so that the belt passing over the top of the drive shaft is pulled toward the drive shaft. Belt 60 is trained around the bottom of the horizontal drive pulley 46 to over one of the horizontal knee idlers 36 to over one of the arm horizontal idlers 42. The belt goes around vertical directional idler 50 along the front or outside of a line of a group of rings 16 with vertical axis. As illustrated, a group of rings will be six rings, particularly referring to FIG. 3. However, it will be understood that a group of rings could be more than six rings. The belt 60 extends between one of the vertical ring idlers 56 and the rings 16. Then it extends along and runs along the outside of the rings to another of the vertical ring idlers 56 and goes between the idler 56 and the rings 16. The belt will extend around the end ring of the group and then back along the opposite side of the line. The opposite side of the line is called the inside of the line or the back side. Although no idlers have been shown along the opposite side, it will be understood by those skilled in the art that some could be placed therealong if desired. The belt extends back to the ring adjacent to the bracket 26 and extends around the ring adjacent to bracket 26 over the other horizontal arm idler 42, over the other horizontal knee idler 36 and back over the top of the horizontal drive pulley 46.

Belt 62 extends from the bottom of drive pulley 48 over one of the knee idlers 38 and over one of the arm idlers 44 and around the ring 16 adjacent to the ring bracket 26. The belt 62 then extends on a run along the back side or inside of a line group of rings, again including six rings, and around the end ring of the group and back along a run along the front or outside of the group. As before, when the belt 62 comes by one of the ring idlers 56 it is trained between the ring idler 56 and the two rings 16, which the ring idler 56 is between. The belt 62 then extends around the directional idler 54 and over the other of the arm idlers 44 then over the other knee idler 38 and round the top of the drive pulley 48.

Thus it may be seen that we have provided a simple, inexpensive and dependable drive means for rotating the spinning rings.

As an aid to correlating the terms of the claims to the exemplary drawing the following catalog of elements is provided:

10 spindle rail
12 spindle
14 ring rail
16 ring
18 drive shaft
20 bearing
22 drive element
24 ring arm
26 ring bracket
28 spindle arm
30 spindle bracket
32 knee
34 knee shaft
36 knee idler
38 knee idler
40 arm shaft
42 arm idler
44 arm idler
46 drive pulley
48 drive pulley
50 directional idler
52 cross bar
54 directional idler
56 ring idler
60 belt
62 belt The embodiment shown and described above is only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific example above do not point out what an infringement of this patent would be, but are to enable the reader to make and use the invention.

We claim as our invention:

1. In a machine having a frame including:

a. a spindle rail,
b. vertical bobbin spindles on the spindle rail,
c. the bobbin spindles adapted to be rotated at high speed,
d. a ring rail mounted on the frame to move up and down,
e. a ring with a vertical axis on the ring rail around each bobbin spindle,
f. each of said rings mounted for rotation on the ring rail,
g. each ring adapted to carry a traveler for feeding yarn to each bobbin,
h. a ring arm pivoted to the ring rail,
j. a spindle arm pivoted to the spindle rail,
k. said ring arm and said spindle arm pivoted together at a knee,
m. at least two knee idlers journalled to one of said arms near the knee, and
n. a horizontal drive pulley journalled to the spindle rail, wherein the improvement comprises the following structure for rotating the rings in combination with the above:

o. at least two arm idlers journalled to the ring rail near where the ring idler arm is pivoted to the ring rail,
p. ring idlers attached to the ring rail adjacent to the rings,
q. at least one vertical directional idler journalled to the ring rail near the arm idlers to change the direction of a belt,
r. a belt trained over said horizontal drive pulley over one of said knee idlers,
s. over one of said arm idlers,
t. around one of said rings with vertical axes,
u. along one side of a line of a group of rings,
v. around the end ring of the group, and
w. along the opposite side of the line back around the directional idler and over the other arm idler,
x. over the other knee idler, and
y. back to the horizontal drive pulley,
z. said belt running between said ring idlers and the rings.

2. The invention as defined in claim 1 further comprising:

aa. there being two horizontal drive pulleys and two belts for each knee,
bb. there being a total of four horizontal knee idlers, two on each side of the arms,
cc. a total of four horizontal arm idlers, two on each side of the ring arms,
dd. at least two of the vertical directional idlers, and
ee. each belt extending around at least six rings with vertical axes.

3. In a spinning machine having a spindle rail, bobbins mounted on the spindle rail for rotation, a vertically reciprocating ring rail including spinning rings supported thereon for receiving the bobbins therethrough and mounted to move longitudinally of the bobbins, a traveller on each of said spinning rings for feeding yarn to the bobbin received through the ring, a spinning ring holder supporting each of said spinning rings for rotation in the ring rail, each of said spinning ring holders including a tubular drive sleeve extending through the said ring rail, the combination therewith of improved drive means for rotating and spinning ring holders and including a drive shaft with a drive pulley thereon, an endless drive belt in driven engagement with said drive pulley, a scissor-type linkage system interconnecting said spindle rail and said ring rail, said linkage system including an upper arm pivotally connected at one end to said ring rail, a lower arm pivotally connected at one end to said spindle rail, the other ends of said upper and lower arms being pivotally connected together, first idler pulley means rotatably supported at the pivotal interconnection of said other ends of said upper and lower arms, second idler pulley means rotatably supported on the pivotal interconnection of said one end of said upper arm and said ring rail, said first and second idler pulley means directing said endless drive belt along said linkage system and in driving engagement with at least one of said tubular drive sleeves to impart rotation to the corresponding spinning ring holder and spinning ring.

* * * * *